United States Patent [19]

Raible et al.

[11] 4,036,135

[45] July 19, 1977

[54] OFFSET DUPLICATOR WITH MASTER TREATING MEANS

[75] Inventors: Hermann Raible; Rolf Muller, both of St. Georgen, Germany

[73] Assignee: Mathias Bauerle GmbH, St. Georgen, Germany

[21] Appl. No.: 589,026

[22] Filed: June 23, 1975

[30] Foreign Application Priority Data

Sept. 30, 1974 Germany ..... 2446608

[51] Int. Cl.[2] ..... B41F 7/00

[52] U.S. Cl. ..... 101/463; 101/132.5; 101/465

[58] Field of Search ..... 101/130, 132, 132.5, 101/141–144, 450, 451, 463, 465, 466, 415.1

[56] References Cited

U.S. PATENT DOCUMENTS

| | | | |
|---|---|---|---|
| 3,426,678 | 2/1969 | Carper et al. | 101/132.5 |
| 3,682,095 | 8/1972 | Kaminstein et al. | 101/141 X |
| 3,683,803 | 8/1972 | Gray et al. | 101/132 |
| 3,742,244 | 6/1973 | Raible | 101/142 X |
| 3,788,221 | 1/1974 | Borneman | 101/132 X |
| 3,861,306 | 1/1975 | DuBois et al. | 101/132.5 X |
| 3,866,534 | 2/1975 | Schinke et al. | 101/144 |

*Primary Examiner*—Edgar S. Burr
*Assistant Examiner*—R. E. Suter
*Attorney, Agent, or Firm*—Finnegan, Henderson, Farabow & Garrett

[57] ABSTRACT

A lithographic duplicating machine includes a device for feeding an imaged master from a stack of masters through a treating unit, containing conversion fluid for converting the imaged surface of the master, to a master cylinder. A motor drive system is provided for conditioning the master cylinder for operation at a printing speed and a starting speed for drawing the master through the treating unit. The motor speed is controlled by an electronic switching arrangement which receives input signals from machine responsive electrical switches and manually settable potentiometers to which the motor drive system is connected. A control device comprising contoured cams and a blocking mechanism is provided for operating the master cylinder at the starting speed, and a one-revolution mechanism including a cam operated linkage, cam discs and a follower are provided for rotating the master cylinder through a single revolution only during attachment of the master to the master cylinder while operating at the starting speed. A clamping device on the master cylinder clamps one end of the master as it exits from the treating unit and, upon completion of the conversion operation and with the master wrapped about the master cylinder, the speed of the master cylinder is operated to the printing speed. On completion of the printing operation, the master is ejected from the master cylinder and the machine is in a condition for receiving a new master for a subsequent printing operation.

19 Claims, 9 Drawing Figures

220V~
S1
S2
P1
P2
a
b

OFFSET DUPLICATOR WITH MASTER TREATING MEANS

BACKGROUND OF THE INVENTION

This invention generally concerns offset printing machines and, more particularly, an offset duplicator equipped with an automatic device for applying and removing a master, which can be automatically controlled by a control device capable of switching on and off the various functions of the machine in succession according to a pre-set program, and with a treating device having a pass-through dip tank for converting the master as well as conveyor rolls for moving the master away from the dip tank.

In order to use such offset duplicator with masters, known as zinc oxide masters which are imaged on electrostatic master imagers or copiers, it is necessary to equip the machine with a treating device known as a converter apparatus. Such treating devices are used for the chemical pre-treatment of the zinc oxide masters to render the unimaged areas of the master moisture-receptive.

Most of the known office offset printing machines are equipped with so-called etching or pre-moistening mechanisms in which etching fluid is applied to the surface of direct image and other masters, but not to zinc oxide masters which require conversion. Direct image masters are normally treated after the master is attached to the master cylinder, by means of a saturated roller or a non-rotatable applicator member having a saturated absorptive coating. However, because zinc oxide masters require a conversion rather than an etching treatment, in order to properly treat the master it is not normally converted on the master cylinder. Only after such treatment of the master can the duplicator be operated further according to a pre-set program.

It is known that the most satisfactory conversion method comprises passing the master to be treated through a conversion fluid contained in a pass-through dip tank, by advancing the master through the tank at a proper transport speed prior to its being attached to the master cylinder.

In one known machine which utilizes this method, a duplicator and an electrostatic master imaging apparatus are combined into one structural and functional unit as shown, for example, in U.S. Pat. No. 3,426,678. In the device of the patent there is situated in the transport path of the master, following a developer station in the transport path, a conversion bath through which the zinc oxide master must pass. After leaving the conversion bath the master arrives first at a waiting station which is provided with a pair of conveyor rolls positioned directly adjacent the master cylinder to which the master is to be attached. The conveyor rolls, which in their normal position are lifted or separated from each other, are driven by the master cylinder at the peripheral speed of, and independently of any conveyor part of the copying or conversion apparatus. Since the master speed through the conversion bath is relatively low to allow time for the required chemical reaction, while the speed of the master cylinder is normally high to provide high productivity, the waiting station is required. However, such a waiting station requires a suitable support at ready position on which the master to be attached to the master cylinder can repose while it is waiting to be attached to the cylinder. This waiting station extends the overall size of the machine since it requires a surface area sufficiently large to accommodate the master.

In known offset machines which provide a treating device with a pass-through dip tank, such waiting stations for the converted master are required, as mentioned supra, because the converting speed, i.e., a speed of about 3.5 meters per minute at which the master must be passed the dip tank to be converted properly, does not correspond with the printing speed which is about 50 meters per minute. However, because such a master feeding device having a treating tank includes in its lengthwise dimension a stack of master from which individual masters are advanced, the treating tank with squeeze rolls and the waiting station for the converted master, the overall size of the machine is large and bulky and does not readily provide a compact office offset duplicator.

SUMMARY OF THE INVENTION

The present invention provides for equipping an office offset duplicator with a pass-through treating tank for converting zinc oxide masters in such a manner, and so controlling the duplicator to the use of a pass-through treating tank, that the waiting station normally associated with prior art devices is eliminated and the master can be clamped to the master cylinder directly as it exists from the treating bath.

The device of the present invention provides a pass-through dip tank arranged in at least an approximately horizontal plane immediately adjacent the master cylinder between the master cylinder and a master sheet feed table or magazine, and conveyor rolls for advancing the master from the tank to the master cylinder. The rolls can be driven for a fixed period of time at a starting speed differing from the normal printing speed and corresponding to a predetermined time required to properly convert the master.

This arrangement permits the use of a pass-through dipping process for converting masters in compact office offset duplicators because the waiting station space requirement is no longer necessary. Moreover, the present invention provides the further advantage that possible inadvertent ejection of the master after leaving the treating bath cannot occur because the masters are attached to the master cylinder immediately as they exit from the treating bath. To obtain properly timed operation between the conveying of the master during the feeding and conversion operations, the present invention further provides that the conveyor rolls for delivering one end of the master to a clamping device of the master cylinder, and a feed roll for advancing a master from a supply of masters on a feed table, can each be independently coupled and uncoupled into and out of driving relation with the master cylinder. In this way, not only is the maintaining of the prescribed treating time for passage speed of the master through the treating bath assured but, also, there is provided substantial reliability of function with the greatest possible protection to the master per se. At the same time, it is possible at any suitable time to transfer the conveyor drive of the master from the feed roll to the conveyor rolls which are at the exit of the pass-through dip tank.

The present invention provides for driving the master cylinder at two different speeds, a starting speed for drawing the master through the conversion bath while the master is being attached to the master cylinder and a printing speed at which copy sheets are duplicated.

While it is also possible, in principle, to achieve greatly differing drive speeds of the master cylinder by the use of mechanical devices, the present invention further provides a direct current shunt motor for driving the machine. By means of an electronically controlled device and a programmed control apparatus the motor may be set to operate at different and easily adjustable roational speeds. In this way the reliability and versatility of operation is greatly increased and the use of expensive switch and clutch mechanisms is avoided.

The fact that the two master transport devices can be controlled through a common follower lever, by a control disc or cam coupled to the master cylinder by means of a one revolution mechanism, offers the advantage of a simple mechanical means for providing accurate timed control of the conveyor drives for the master.

The reliability of operation is further assured by providing a control disc or contoured cam having cam timing surfaces of different radius or radial depth, positioned on the periphery of the cam such that the cam timing surfaces follow one another. The first timing surface as viewed in the direction of rotation is effective to control only the operation of the drive coupling for the feed roll, and the second timing surface is effective to operate only the drive of the conveyor rolls. In this way it is assured that the master in the transport path is advanced in each case by only one drive means, either the feed roll for advancing the master from the magazine stack or by the conveyor rolls for advancing the master from the treating bath to the master cylinder. Thus, any differences in the conveying speed of these conveyor drives cannot damage the master and continuous transport of the master through the conversion fluid is assured.

It is important also that the length of the first timing surface of the contoured cam corresponds to the delivery time of the master from the feed table to the conveyor rolls, and that the length of the other cam timing surface corresponds to the travel time of the master sheet from the conveyor rolls to the clamping device of the master cylinder. Thus, while retaining the continuity of the driving of the master during the transport, the driving of both the feed roll and the conveyor rolls is maintained only, in each case, as long as necessary for conveying one end of the master entering the following drive means. The conveyor rolls are arrested the moment the master is clamped to the master cylinder. At this time the master cylinder effects the remaining transport of the master through the treating bath at the starting speed and the conveyor rollers serve as squeeze rolls. This offers a further advantage in that, because of the tension exerted on the master by the master cylinder during its further rotation, the master lies smooth and flat against the surface of the master cylinder.

By designing the conveyor rolls as pressing or squeeze rolls and arranging the rolls in a group of three, in which two rolls in each case are in driving relation and also in pressure contact, there is also provided an arrangement for removing excess converter fluid clinging to the master upon leaving the treating bath such that the master is advanced to the master cylinder in a condition ready for printing.

It is an object of the present invention to provide an improved lithographic duplicating machine including a treating unit for automatically programming the treating of the imaged master in timed relationship with its attachment to the master cylinder.

Another object of the invention is to simplify the lithographic operation by varying the rotary speed of the master cylinder to coincide with the speed of the conveyor rollers for transporting one end of the master from the conveyor rollers to the clamping means, to thereby provide sufficient exposure of the master to the conversion solution and then operate the machine in a printing mode.

Another object is to provide a compact office duplicator by reducing the length of the transport path of the master from the magazine, through the conversion bath to the master cylinder.

A further object of the invention is to provide a highly reliable and easy to operate machine equipped with a selectively settable program means for operating the master cylinder at different speeds and, simultaneously, operating the feed roll and the conveyor rolls in timed relationship with the starting speed of the master cylinder.

Other objects, features and advantages of the invention will appear hereinafter as the description proceeds.

IN THE DRAWING

Figures 1, 5:
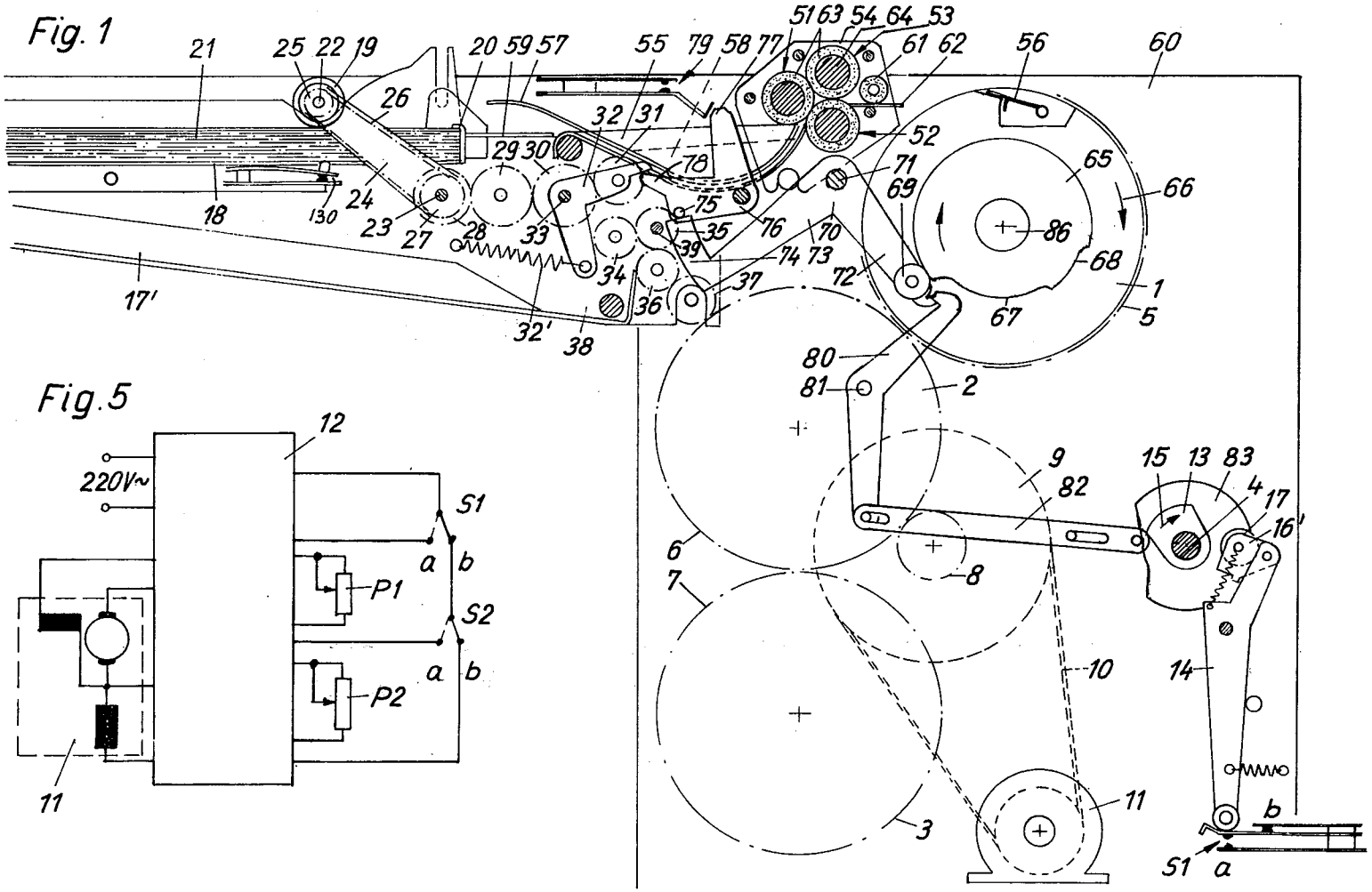
FIG. 1 is a side elevation in section showing an offset duplicator comprising master supplying and master treating means in accordance with the present invention.
Figures 2, 2A:
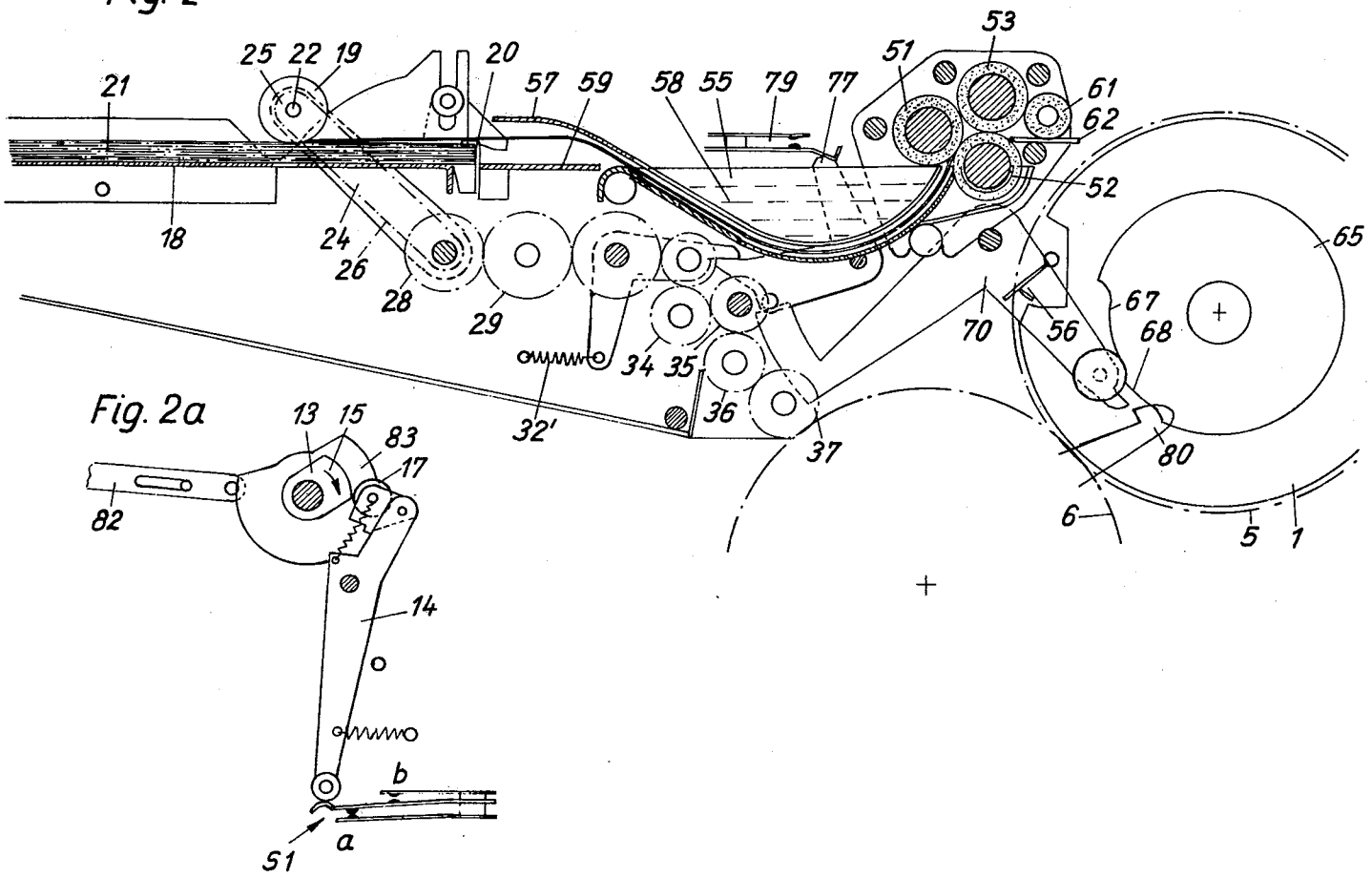
FIG. 2 is similar to FIG. 1 and shows the master in a position just prior to one end thereof entering a nip of the conveyor rollers for delivering the one end of the master to a clamping means on the master cylinder.
Figure 3:
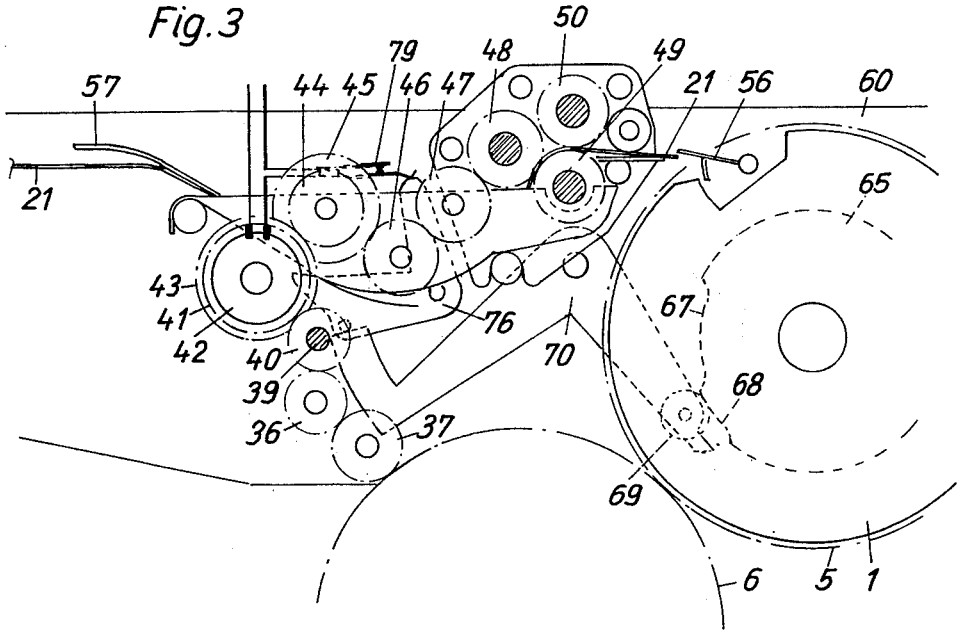
Figure 4:
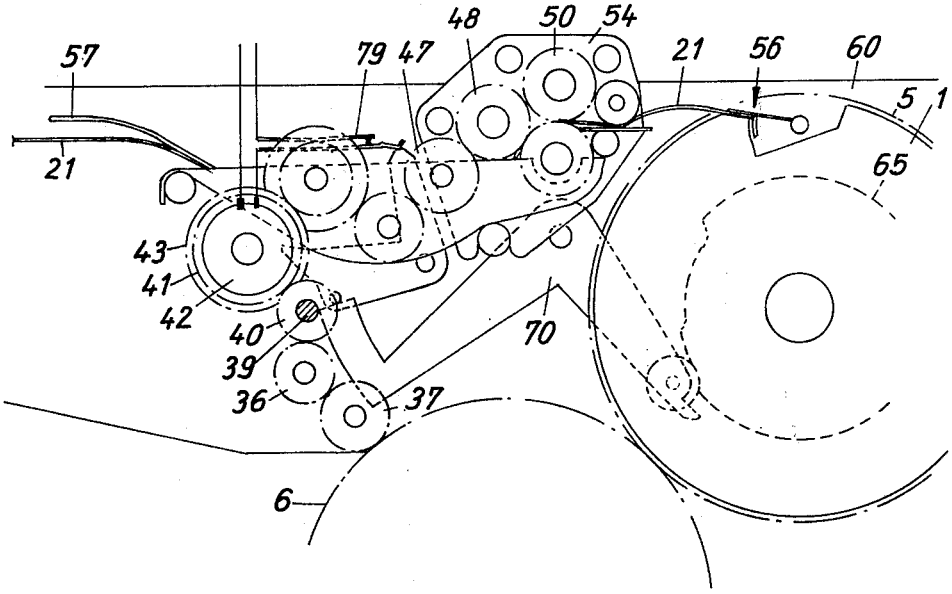
Figure 6:
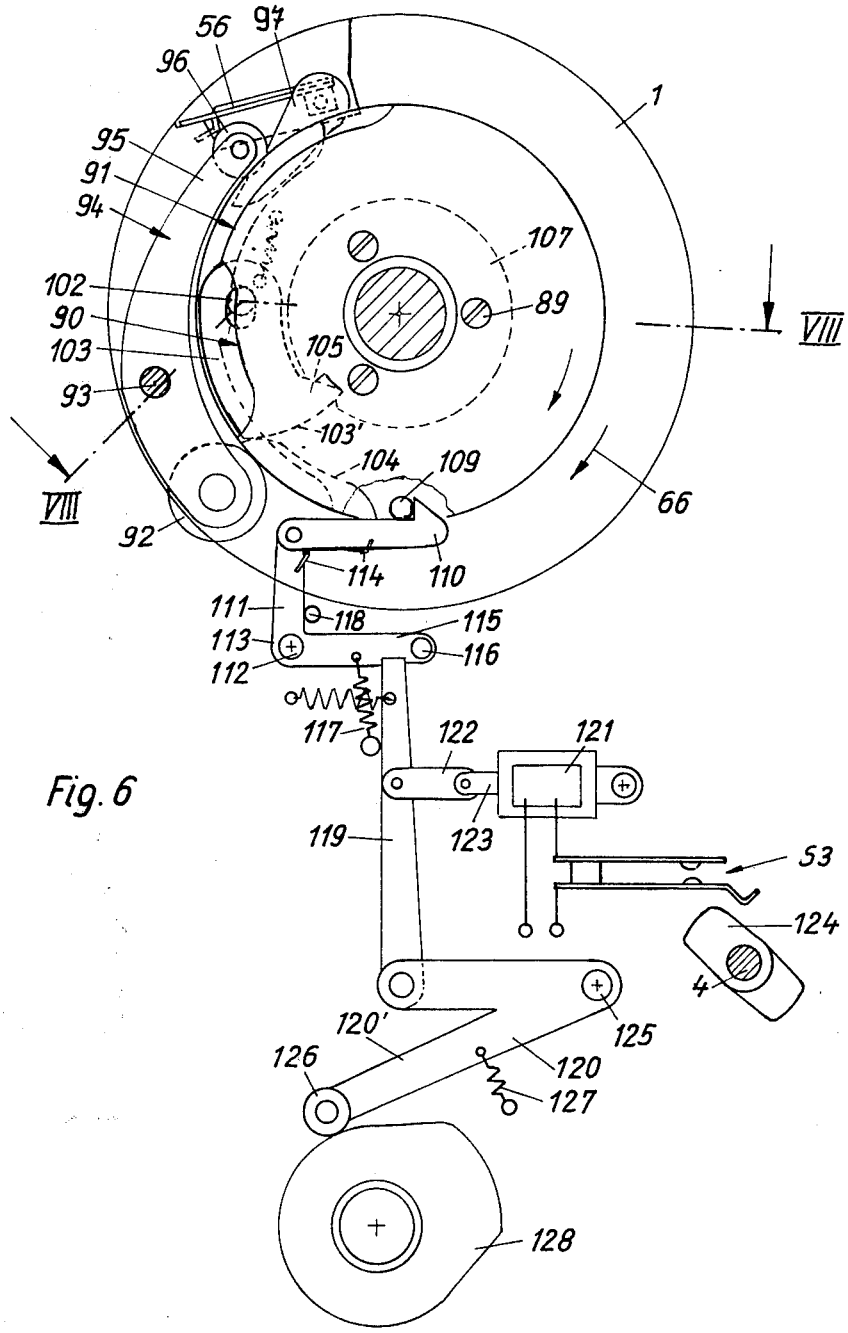
Figure 7:
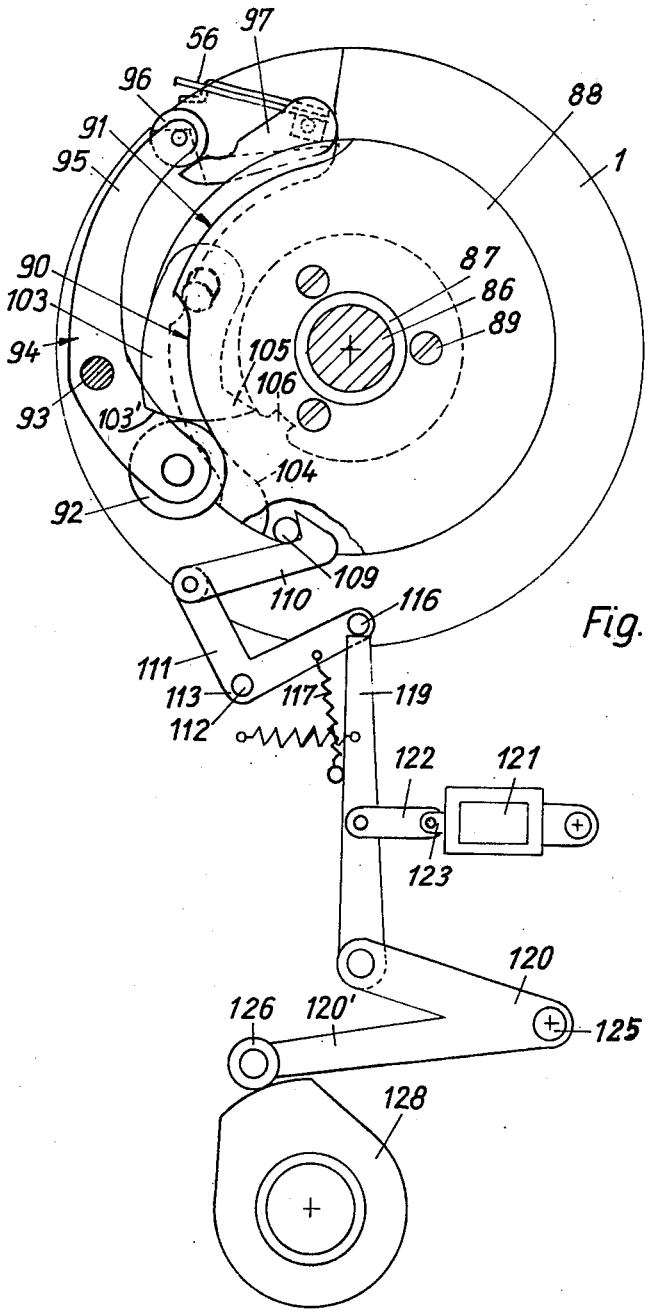
Figure 8:
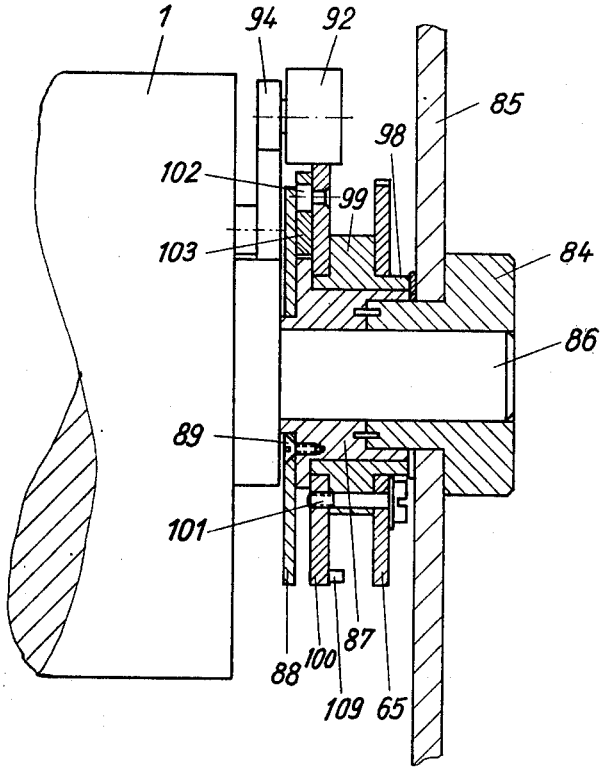

FIG. *2a* is a side elevation of a cam means for operating control means for actuating the drive couplings associated with the feed roll and the conveyor rollers, showing the parts in an operative position;

FIG. 3 is similar to FIG. 2 and illustrates the master in a position just prior to the one end thereof being secured by the clamping means for retaining the master on the master cylinder;

FIG. 4 is similar to FIG. 3 and shows the one end of the master secured to the master cylinder by the clamping means;

FIG. 5 is a schematic diagram of a selectively settable program means;

FIG. 6 is a side elevation of the master clamping mechanism shown in a closed position;

FIG. 7 is similar to FIG. 6 but shows the arrangement of the clamping mechanism in an open position for ejecting a used master; and FIG. 8 is a section taken substantially along the plane of the line VIII — VIII of FIG. 6.

DESCRIPTION OF THE PREFERRED EMBODIMENT

As shown in FIG. 1, the duplicating comprises a master cylinder 1, a blanket cylinder 2, an impression cylinder 3 and a control shaft 4. The control shaft 4 will be further described with reference to FIG. *2a* and is referred to at this time to explain the operation of the control means associated with the control shaft 4.

The cylinders 1, 2 and 3 are each provided with a gear wheel 5, 6 and 7 respectively, and the gears are in driving relationship with each other as represented by the broken lines in FIG. 1. The gear wheel 6 is driven by a pinion 8 integral with a pulley 9, and the pulley 9 is driven by a belt 10 associated with a drive motor 11. The motor drive system 11 is an electronically controlled DC shunt motor adapted for operation at various RPM's. The motor speed is controlled by an electronic switching arrangement 12, shown schematically in FIG. 5, connected to a 220 V. AC supply line, and which receives input signals from a pair of machine responsive electrical switches S1, S2 nd two manually settable potentiometers P1 and P2, to which the motor drive system 11 is connected.

The switches S1 and S2 are arranged in series (FIG. 5) and are actuated through the operation of the control shaft 4. The control shaft 4 is operable in both directions of rotation and permits switching the speed of the motor 11 among any one of three different RPM ranges. The switch S1 when actuated to close a contact *a* provides a range of 300 to 1,600 RPM wherein the range 300 to 1,600 can be selectively set by means of the potentiometer P1 and represents the starting speed.

The control shaft 4 is operable from an initial position through a series of intermediate positions and back to the initial position as fully disclosed in U.S. Pat. No. 3,742,244 assigned to the same assignee as the present invention.

The switch S2 is effective only when the switch S1 is actuated to close a contact *b*. Thus, the switch S2 when actuated to close the contact *a* provides a range of 1,600 to 4,500 RPM wherein the range 1,600 to 4,500 is selectively settable by means of the potentiometer P2. The range of 1,600 to 4,500 RPM represents the printing speed of the duplicating machine. With both switches S1 and S2 actuated to close the contacts *b*, the motor 11 operates at its set normal speed of 3,250 RPM which corresponds to the rotational speed of the control shaft 4 in both the forward and reverse directions of operation.

The switch S1 is under control of a cam 13 provided on the control shaft 4. The cam 13 extends over the angular distance of the two side-by-side switching positions of the control shaft 4 and, through a lever 14, actuates the switch S1 as shown in FIGS. 1 and 2*a*. The switch S1 is operable only in the forward direction of rotation of the control shaft 4, indicated by the arrow 15, by providing on the lever 14 a cam follower 17, supported on a member 16', resiliently biased in a direction opposite to the direction of rotation of the control shft 4, as shown in FIG. 2. A similar arrangement is provided for operating the switch S2.

Positioned in a substantially horizontal plane above the axis of a shaft 86 rotatably supporting the master cylinder 1 in a machine frame 17', there is provided a feed table 18 for supporting a supply of masters 21. A feed roll 19 is provided for feeding a master 21 from the top of the stack, at a speed corresponding to the starting speed of the master cylinder 1, by urging one end of the master against a corner separator means 20 to thereby buckle and separate the top master 21 from the stack. The master cylinder 1 is operated to the starting speed in timed relation with the feeding of the master from the stack by the feed roll 19.

The feed roll 19 is supported on a shaft 22 extending transversely to the feed table 18 and is connected with the shaft 22 through a one-way clutch, not shown in the drawing. The shaft 22 is supported by a pair of levers 24, one at each side of the feed table 18, arranged for swinging movement on a stationary shaft 23. A sprocket 25 is provided on the shaft 22 and is drivingly connected by a chain 26 with a sprocket 27 rotatably supported on the shaft 23. The sprocket 27 is driven by a gear 28 integral therewith and in meshing engagement with a gear 29 of a gear train comprising gears 30 and 31. The gear 31 is supported on a pivotal bell crank 32 adapted to pivot about an axis 33 of the gear 30 from the position shown in FIG. 1 to the position shown in FIG. 2 wherein the gear 31 is in mesh with a gear 34 defining a drive coupling. The gear 34 is driven by a gear 35 of a gear train including gears 36, 37 and the gear wheel 6 of the blanket cylinder 2.

The gears 29, 34, 36 and 37 are each supported on stub shafts provided in a frame side plate 38 and the gear 35 is mounted on a shaft 39 having a gear 40 mounted thereon on the opposite side of the frame 17', as shown in FIGS. 3 and 4. The gear 40 is in meshing engagement with a gear 41 associated with an electromagnetic drive coupling 42, and a gear 42 also associated with the electromagnetic drive coupling 42 is in mesh with a gear 44 which is integral with a gear 45. This gear arrangement provides a drive to conveyor rollers 51, 52 and 53, at a speed corresponding to the starting speed of the master cylinder 1, through a gear train comprising gears 46, 47 and gears 48, 49 and 50 provided on the conveyor rollers 51, 52 and 53, respectively.

The conveyor rollers 51, 52 and 53 are mounted in a frame 54 and are in rolling contact with each other. Also, the conveyor rollers are arranged such that a master 21 exiting at an angle of about 45° from a treating unit 55 can be directed and advanced in a horizontal plane to a clamping means 56 of the master cylinder 1.

The treating unit 55 comprises a tank having a concave basin and includes a guide plate 57 conforming generally with the shape of the tank and spaced slightly above the bottom of the tank. The guide plate 57 guides the master 21 in its travel from the supply of masters through a conversion solution bath 58 to the conveyor rollers 51, 52 and 53. A plate member 59 is provided intermediate the corner separator means 20 and the treating unit 55 to support the master in its advancement to the treating unit 55.

The treating unit 55 is removably mounted in a frame 60 and is releasably secured to the frame 54 supporting the conveyor rollers 51, 52 and 53. Also mounted in the frame 54, at a position adjacent the master exiting side of the conveyor rollers 52 and 53, are a guide roll 61 and a guide plate 62 for directing the master 21 to the clamping means 56.

The conveyor rollers 51, 52 and 53 are provided with an elastic but relativey hard surface covering 63 provided on a core 64. The surface covering 63 serves to advance the master 21 exiting from the treating unit 55 and also provides a pressing or squeezing action to the master 21 to remove excess conversion fluid therefrom so that the master is in a condition ready for duplicating when it is attached to the master cylinder 1.

For controlling actuation of the gear 31 into and out of meshing relation with the gear 34, and operation of the electromagnetic drive coupling 42, there is arranged on the shaft 16 a first control means comprising a contoured cam or control disc 65. The contoured cam 65 is provided with a pair of timing surfaces 67 and 68 of different radial depths and spaced one following the other, as shown in FIGS. 1 and 2. The timing surface 67, or first timing surface as viewed in the direction of rotation indicated by arrow 66 in FIG. 1, is recessed to a radial depth greater than the depth of the timing surface 68. The contoured cam 65 is drivingly coupled with the master cylinder 1 through a one-revolution control means, such that the contoured cam 65 rotates through a single revolution only at the proper time in each cycle of operation.

The outer periphery of the contoured cam 65 and the timing surfaces 67 and 68 coact with a follower roll 69 mounted on an arm 72 of a bell crank 70. The bell crank 70 is pivotally supported on an axle 71 in the frame 60 and comprises an arm 73 provided with a finger 74 which coacts with a pin 75 of a two-arm lever 76. An arm 78 of the lever 76 coats with the bell crank 32 and an arm 77 of the lever 76 extends into a zone adjacent a switch 79 included in the electrical circuit of the electromagnetic drive coupling 42. A spring 32' biases the bell crak 32 in a clockwise direction as viewed in 120 clockwise FIG. 1. The bell crank 70 is also acted upon by a blocking device 80 pivotally supported on a pin 81, as shown in FIG. 1. The blocking device 80 is pivotally actuated by a push-rod 82 (FIGS. 1 and 2a) associated with a control cam 83 mounted on the control shaft 4 defining a second control means.

The one-revolution control means associated with the contoured cam 65 is included in the mechanism for actuating the clamping means 56 and will now be described with reference to FIGS. 6, 7 and 8. As shown best in FIG. 8, the master cylinder 1 is provided with an axle 86 rotatably supported in a bushing 84 mounted in a frame 85. A bushing 87 is mounted on the axle 86 and is non-rotatably secured to the bushing 84. A cam disc 88 is secured by fastening means 89 to the bushing 87 at the side of the bushing 87 adjacent an end wall of the master cylinder 1. The periphery of the cam disc 88 is provided with a pair of timing surfaces 90 and 91, see FIGS. 6 and 7, in which the timing surface 90 is recessed to a radial depth greater than the timing surface 91. The cam disc 88 coacts with a follower roll 92 mounted at one end of the lever 94, and the lever 94 is pivotally supported on a pin 93 provided in the end wall of the master cylinder 1. The lever 94 is carried around by the rotating master cylinder 1 such that the follower roll 92 travels in a closed path. The other end 95 of the lever 94 is provided with a roller 96 adapted to coact with an actuator member 97 associated with the clamping means 56.

As shown in FIG. 8, a bushing 98 is rotatably supported on the bushing 87. A body 99 of the bushing 98 provides for securing thereto the contoured cam 65 and a cam disc 100 with fastening means 101. The cam disc 100 is positioned adjacent the cam disc 88 and is provided with a pin 102 for pivotally supporting a pawl 103. The cam disc 88 and the pawl 103 are acted upon simultaneously by the follower roll 92 of the lever 94.

The cam disc 100 is provided with a timing surface 104 having a radial depth corresponding to the radial depth of the timing surface 90 of the cam disc 88. One end of the timing surface 104 terminates adjacent an arcuate surface 103' of the pawl 103. As shown in FIGS. 6 and 7, the pawl 103 comprises a nose portion 105 urged under spring bias in a counter clockwise direction towards the axle 86. In a neutral or rest position of the control and cam discs 65 and 100 respectively, the nose portion 105 is positioned within a notch 106 provided in the periphery of an annular flange 107 associated with the bushing 87. In each revolution of the control disc 65, cam disc 100 and bushing 98, the follower roll 92 coacts with the timing surface 104 to urge the pawl 103 in a clockwise direction against the spring bias, as viewed in FIGS. 6 and 7, thereby withdrawing the nose portion 105 from the notch 106 and presenting the arcuate surface 103' in the path of movement of the follower roll 92. Thus, the pawl 103 is acted upon and carried along by the follower roll 92 after the follower roll 92 exists from the timing surface 104 and is in rolling engagement with one or the other of the cam discs 88 and 100.

In the neutral position of the cam disc 100, the timing surface 104 is displaced circumferentially from the timing surfaces 90 and 92 of the cam disc 88 a distance such that the follower roll 92 acts on the outer periphery of one of the cam discs 88 and 100, thereby urging the roller 96 against the actuator member 97 to maintain the clamping means 56 in a closed or master clamping position for retaining the master on the master cylinder 1. The coaction of the follower roll 92 with the timing surfaces 90 and 91 is effected through a lever mechanism to be described hereinbelow.

The cam disc 100 is provided with a pin 109 adapted to be engaged by a hook lever 110 pivotally mounted on a lever 111 of a bell crank 113. The bell crank 113 is pivotally supported on a pin 112 and, as shown in FIG. 6, is biased by a torsion spring 114 into engagement with the pin 109. An arm 115 of the bell crank 113 is provided with a fixed pin 116 and, as viewed in FIGS. 6 and 7, the bell crank 133 is biased in a clockwise direction by a spring 117 to urge the arm 115 against a stop member 118.

A tappet 119 is positioned beneath the bell crank 113 and is actuable between an inactive position shown in FIG. 6, and an active position in contact engagement with the pin 116 as shown in FIG. 7 in response to energization of a solenoid 121. The tappet 119 is connected to the solenoid 121 by a strap 112 and an anchor 123. The solenoid 121 is energized in response to closing of a switch S3 through the action of a cam member 124 mounted on the control shaft 4.

A double-armed lever 120 is pivotally supported on a pin 125 and an arm 120' of the lever 120 mounts a follower roll 126. The follower roll 126 is biased by a spring 127, FIG. 6, and is adapted for rolling engagement on the periphery of a cam disc 128 which is rotated in timed relationship with the master cylinder 1 during operation of the duplicating machine. Thus, the tappet 119 is moved in vertical lifting movements such that, in response to energization of the solenoid 121 and movement of the tappet 119 to the active position of FIG. 7, the tappet 119 acts against the pin 116 of the bell crank 113 to transmit rotating movement of the control disc 65 and the cam disc 100 through the arrangement of the bell crank 113, the hook lever 110 and the pin 109 in the cam disc 100.

The action of the tappet 119 imparts rotary motion to the control and the cam discs 65 and 100 respectively, on the bushing 98 in the direction of the arrow 66 in FIG. 6, a distance such that the nose portion 105 of the pawl 103 is caused to move out of the notch 106. Thus, the arcuate surface 103' of the pawl 103 is displaced to a position outside of the perpheries of the discs 65, 88 and 100 and in the path of travel of the follower roll 92. At this time the timing surface 104 of the cam disc 100 is rotated to a position wherein the follower roll 92 is caused to move into the timing surface 90 of the cam disc 88, thereby pivoting the lever 94 so as to move the roller 96 in a direction away from the actuator member 97 to actuate the clamping means 56 to its open or master ejecting position for ejecting the master 21, as shown in FIG. 7.

The timing surface 91 of the cam disc 88 also coacts with the follower roll 92 and is recessed to a radial depth less than the radial depth of the timing surface 90. This results in partially closing the clamping means 56 from the master ejecting position to an intermediate or master inserting position for receiving one end of a new master 21 while the master cylinder is rotating at the starting speed. In response to the follower roll 92 exiting from the timing surface 91 and coacting with the outer periphery of the cam disc 88, the clamping means 56 is actuated to the closed position by the roller 96 acting against the actuator member 97. On completion of a full revolution of the master cylinder 1, and the converted master clamped to and wrapped completely about the master cylinder, all of the parts are restored to the positions shown in FIG. 6 wherein the lever 94 and the follower roll 92 are carried by the rotating master cylinder 1, and the master cylinder is operated from the starting to the printing speed. The clamping means remains in the closed position until such time as the solenoid 121 is again energized thereby initiating the operation of the one-revolution control means.

Because the control disc 65 and the cam disc 100 are arranged to be rotated together in each revolution, a definite function setting of the control shaft 4 takes place, namely (see FIG. 1), when the blocking device 80 is released from the arm 72, by the control cam 83 on the control shaft 4, the follower roll 69 coacts with the timing surfaces 67 and 68 of the control disc 65 during attachment of a master 21 to the master cylinder 1. This is the case when, subsequent to a printing operation, ejection of the used master and cleaning of the blanket cylinder 2, as described in the U.S. Pat. No. 3,742,244 referred to supra, the control shaft 4 is rotated to a position in which the switch S1 closes the contact *a* (FIG. 2*a*) and the rotational velocity of the master cylinder is operated to the starting speed corresponding with the transport speed at which the master 21 travels through the treating unit in order to properly convert the imaged surface of the master.

With reference to FIG. 2, as the follower roll 69 is moved to an active position into the timing surface 67, the gear 31 through pivotal movement of the bell crank 32 is moved into meashing engagement with the gear 34 and remains so engaged until such time as the follower roll 69 exits from the timing surface 67 and enters the timing surface 68. The length of the timing surface 67 corresponds to the duration of travel of one end of the master 21 from the corner separator means 20 to the nip of the conveyor rollers 51 and 52.

As shown in FIG. 3, movement of the follower roll 69 from the timing surface 67 to the timing surface 68 causes pivotal movement of the bell crank 70 which, in turn, imparts pivotal motion to the lever 76 and the bell crank 32 resulting in movement of the gear 31 out of meshing engagement with the gear 34 and interruption of the drive of the feed roll 19. Through this pivotal movement, refer to FIG. 4, the arm 77 of the lever 76 actuates the switch 79 thereby energizing the electromagnetic drive coupling 42 for driving the conveyor rollers 51, 52 and 53. The conveyor rollers grip the one end of the master 21 and advance the master through the conversion solution 58 at the starting speed as the one end of the master is being delivered to the clamping means 56, as shown in FIGS. 3 and 4.

In summary, as the one end of the master 21 enters the clamping means 56, the clamping means is closed by a corresponding movement of the follower roll 92 (FIGS. 6, 7 and 8). Thereafter, the follower roll 69 exits from the timing surface 68 and rollingly engages the outer periphery of the control disc 65. This results in de-energizing the electromagnetic drive coupling 42 and discontinuing the drive of the conveyor rollers 51, 52 and 53. Because the drive is discontinued the conveyor rollers no longer exert driving force to the master 21 but function only as squeezing or pressing rolls to remove excess conversion fluid from the master 21. The master is completely wrapped about the master cylinder 1 while the master is being converted solely in response to rotation of the master cylinder at the starting speed. This arrangement maintains the master 21 in a taut condition so that it will lie flat and smooth on the master cylinder 1 in readiness for a duplicating operation.

The rotational speed of the conveyor rollers 51, 52 and 53 is determined by the speed of rotation of the master cylinder 1 so that the one end of the master 21 is assured of arriving at the clamping means 56 at the proper time in the operating cycle. It has been stated earlier that a single revolution only of the cam disc 100 is required to effect opening and closing of the clamping means 56. Because the ejection of a used master 21 occurs after the completion of a printing operation, and the insertion of a new master is not effected until after the blanket cylinder 2 is cleaned, the advancement and insertion of a new master 21 cannot take place in the same machine cycle, i.e., not in the same single revolution of the master cylinder 1 in which the used master 21 is ejected. Therefore, during ejection of the used master 21 the blocking device 80 maintains the bell crank 70 in an inoperative position so that the follower roll 69 is unable to coact with the timing surfaces 67 and 68 of the control disc 65.

To prevent the control and the cam discs 65 and 100 respectively, from being set into motion at an improper time as a result of friction between the follower roll 92 and the cam disc 100, a catch device (not shown in the drawing) may be provided for retaining the bushing 98 in the neutral position of the control disc 65 and the cam disc 100 to hold the control and the cam discs against undesired rotation.

With reference to FIG. 1, there is shown a switch 130 provided on the feed table 18 at a position underlying the supply of masters 21. The switch 130 is included in an electrical circuit with a solenoid (not shown) associated with the control shaft 4, and the switch 130 is maintained in an inoperative state as long as a master is present on the feed table. The switch 130 is effective to prevent the duplicating machine from inadvertently shutting down as long as one or more masters 21 are present on the feed table 18. Thus, in response to advancement of the last master 21 from the stack the switch 130 is actuated to cause the control shaft 4, after the printing operation and cleaning of the blanket cylinder 2 are completed, to be rotatably restored to its neutral position and thereby shut down the duplicating machine.

What is claimed is:

1. A duplicating machine, comprising:

a master cylinder equipped with clamping means operable to a closed position for clamping one end of a master to the master cylinder;

a treating unit for converting the master as it is being wrapped around the master cylinder, feed means operable from an off condition to an on condition for transportiong the master from a supply source to the treating unit;

conveyor means for transporting the master from the treating unit to the clamping means;

drive means for selectively driving the master cylinder at a printing speed and a starting speed;

means causing the master cylinder to operate at the starting speed when the feed means is in the on condition and when the conveyor means is in the on condition;

means causing the feed means to be in the off condition and for rendering the conveyor means operative for delivering one end of the master to the clamping means;

means for rendering the conveyor means inoperative in response to closing of the clamping means; and means operable when the master is wrapped completely around the master cylinder for causing the master cylinder to operate at the printing speed.

2. A machine as set forth in claim 1 in which the conveyor means comprises a plurality of cooperating rollers extending transverse to the direction of master transport and positioned at a master exit end of the treating unit adjacent the master cylinder.

3. A rotary duplicating machine having a master cylinder and a treating unit for converting a master while the master is being attached to the master cylinder, comprising:

selective means operable to drive the master cylinder at a printing speed and at a starting speed;

feed means for feeding a master to the treating unit;

conveyor means for transporting said master from the treating unit to the master cylinder;

clamping means on the master cylinder for clamping one end of the master to the master cylinder;

said drive means driving the feed means and the conveyor means at a speed to move a master at substantially the same speed as moved by the master cylinder when operating at its starting speed, and control means for rendering the drive means inoperative when the clamping means clamps one end of the master to the master cylinder.

4. In a lithographic duplicating machine having a master cylinder, a feed means for feeding a master to a treating unit in a path to the master cylinder, said treating unit serving to convert the master by a conversion fluid, clamping means on the master cylinder and selectively operable in master eject and master clamp modes, and conveyor means in the path for transporting one end of the master from the treating unit to the clamping means on the master cylinder, the combination which comprises:

switching means operable from a first mode for rotating said master cylinder at a printing speed, to a second mode for rotating said master cylinder at a starting speed;

means for controlling the operation of the feed means and the conveyor means at a speed to move a master at substantially the same speed as moved by the master cylinder when rotating at the starting speed;

said control means including a first part controlling operation of the feed means and operable to discontinue operation of the feed means and operate the conveyor means when said one end of the master arrives at the conveyor means; and a second part interconnected with the switching means for discontinuing the operation of the conveyor means when the clamping means is operated to the master clamp mode, whereby the master is drawn through the treating unit while it is being wrapped around the master cylinder during rotation of the master cylinder at the starting speed; and means for causing the master cylinder to operate at the printing speed when the master is wrapped completely around the master cylinder.

5. A machine as set forth in claim 4 in which the first part comprises:

a contoured cam provided with a pair of timing surfaces and rotatable with the master cylinder;

one-revolution control means for driving the contoured cam through a single revolution when said clamping means is operated to the master eject mode;

a first follower means actuable between an inoperative position spaced from the timing surfaces and an operative position coacting subsequentially with the timing surfaces to effect operation of the means for controlling the operation of the feed means and the conveyor means;

blocking means movable from an inactive position to an active position for holding the first follower means in the inoperative position during the master eject mode; and said switching means being operable to actuate the first follower means from the inoperative to the operative position under control of the one-revolution control means.

6. A machine as set forth in claim 5 in which the second part comprises:

a control shaft operable in both directions of rotation;

a first and a second cam means mounted on the control shaft;

lever means including a second follower means coacting with the first cam means for moving the lever means from a first position for activating the switching means to the second mode, to a second position for activating the switching means to the first mode;

a push-rod actuable by the second cam means for moving the blocking means to the inactive position when the switching means is actuated to the second mode; and means responsive to activation of the switching means to the first mode for moving the blocking means to the active position.

7. A machine as set forth in claim 6 in which the switching means is interconnected with a means operable to rotate the master cylinder at a predetermined selective speed.

8. A machine as set forth in claim 5 in which one of the timing surfaces of the contoured cam has a length corresponding to the transport duration of said one end of the master from a supply source to the conveyor means, and the other timing surface has a length corresponding to the transport duration of said one end of the master from the conveyor means to the clamping means.

9. A machine as set forth in claim 5 in which the master cylinder is provided with an axle for rotatably supporting the master cylinder, and the one-revolution control means comprises:

a bushing non-rotatably mounted on the axle;

a first cam disc secured to the contoured cam, said first cam disc and the contoured cam rotatably supported on the bushing for movement from a rest position through a single revolution and return to the rest position;

a pawl pivotally mounted on the first cam disc and biased in a direction towards the axle;

an annular flange on the bushing having a notch therein for receiving the pawl to maintain the first cam disc and the contoured cam in the rest position;

means for imparting rotation to the first cam disc and the contoured cam; and a third follower means carried by the master cylinder in a closed path for moving the pawl out of the notch in response to rotation of the first cam disc and the contoured cam.

10. A machine as set forth in claim 9 in which the first cam disc is provided with a timing surface for receiving the third follower means at a position to coact with the pawl to move the pawl out of the notch.

11. A machine as set forth in claim 9 in which the means for imparting rotation to the first cam disc and the contoured cam comprises:

a pin provided on the first cam disc;

a hook means actuable between an inactive position and an active position for imparting rotation to the first cam disc and the contoured cam;

linkage means operable for actuating the hook means from the inactive position to the active position coacting with the pin; and means interconnected with the second part for operating the linkage means.

12. A machine as set forth in claim 11 in which the linkage means includes a tappet supported for pivotal and vertical movement into and out of operative relation with the hook means, and the means for operating the linkage means comprises:

a solenoid interconnected with the tappet for imparting pivotal movement thereto into operative relation with the hook means when the solenoid is activated;

cam and follower means for imparting vertical movement to the tappet into operative relation with the hook means when the solenoid is activated;

switch means operable for activating the solenoid; and cam means associated with the second part for operating the switch means.

13. A machine as set forth in claim 9 which further includes means for operating the clamping means in the master eject and master clamp modes and in a master insert mode for receiving one end of the master, comprising:

a second cam disc provided with an outer periphery having a first and a second timing surface therein and non-rotably mounted on the bushing;

actuator means operable for positioning the clamping means in the master eject, master insert and master clamp modes when the one-revolution control means is activated; and means for operating the actuator means for sequentially positioning the clamping means in the master eject mode when the third follower means coacts with the first timing surface of the second cam disc, for positioning the clamping means in master insert mode when the third follower means coacts with the second timing surface of the second cam disc, and for positioning the clamping means in the master clamp mode when the third follower means coacts with the periphery of the second cam disc spaced from said first and second timing surfaces.

14. A method of treating a master with a conversion solution while the master is being attached to a master cylinder of a duplicating machine in which the master cylinder is selectively operable at a printing speed and a starting speed, comprising the steps of:

transporting a master to a treating means by feed means operable at the starting speed of the master cylinder;

discontinuing transport of the master by the feed means in response to arrival of one end of the master at conveyor means;

operating the conveyor means for delivering said one end of the master to a clamping means on the master cylinder;

discontinuing the drive of the conveyor means when said one end of the master is clamped to the master cylinder by the clamping means;

operating the master cylinder at the starting speed to draw the master through the treating means while the master is being wrapped around the master cylinder; and operating the master cylinder at the printing speed when the master is wrapped completely around the master cylinder.

15. A duplicating machine including master clamping means, comprising:

a master cylinder for supporting a master and rotatable selectively at a printing speed and a starting speed;

a cam disc interconnected with the master cylinder and provided with an outer periphery having a first and a second timing surface;

follower means carried by the master cylinder for coaction with the cam disc;

said clamping means being positioned on the master cylinder and operable from an open position for ejecting a master to a closed position for master clamping, and through a master inserting position intermediate the open and closed positions; and actuator means for operating the clamping means to the open position when the follower means coacts with the first timing surface of the cam disc and for operating the clamping means to the master inserting position when the follower means coacts with the second timing surface of the cam disc, said actuator means operating the clamping means from the master inserting position to the closed position when the said follower means coacts with the periphery of the cam disc spaced from the first and second timing surfaces.

16. A machine as set forth in claim 15 further comprising means for continuing rotation of the master cylinder at the starting speed when the clamping means is operated to the closed position and while the master is being wrapped around the master cylinder; and means for operating the master cylinder from the starting to the printing speed when the master is wrapped completely around the master cylinder.

17. A duplicating machine, comprising:

a master cylinder having a clamping means thereon for clamping one end of a master to be attached to the master cylinder;

a treating unit for converting the master while the master is being attached to the master cylinder;

feed means operable to transport the one end of the master through the treating unit to a conveyor means operable for delivering the one end of the master to the clamping means;

means for operating the master cylinder from a printing speed to a starting speed upon operation of the feed means;

means for discontinuing operation of the feed means and for operating the conveyor means when said one end of the master arrives at the conveyor means; and means for discontinuing operation of the conveyor means when the clamping means clamps said one end of the master to the master cylinder.

18. A machine as set forth in claim 17 further comprising:

drive means for driving the feed means and the conveyor means at a speed to move a master at substantially the same speed as moved by the master cylinder when rotating at the starting speed.

19. A machine as set forth in claim 17 further comprising:

means for operating the master cylinder at the printing speed when the master is wrapped completely around the master cylinder.

* * * * *